United States Patent [19]

Marsh

[11] 4,452,598

[45] Jun. 5, 1984

[54] APPARATUS FOR CUTTING PRINTING PLATES

[75] Inventor: Charles R. Marsh, Romiley, England

[73] Assignee: Auto-Masters Ltd., Cheshire, England

[21] Appl. No.: 349,566

[22] Filed: Feb. 17, 1982

[30] Foreign Application Priority Data

Feb. 17, 1981 [GB] United Kingdom ..... 8104972

[51] Int. Cl.[3] ..... B26D 3/08; B26D 7/01

[52] U.S. Cl. ..... 493/354; 83/881; 83/395; 83/685; 83/695

[58] Field of Search ..... 83/881, 395, 467 A, 83/695, 685; 493/354

[56] References Cited

U.S. PATENT DOCUMENTS

| | | | |
|---|---|---|---|
| 1,082,985 | 12/1913 | Wilder | 83/684 X |
| 2,156,015 | 4/1939 | Greiner | 83/467 A |
| 2,964,004 | 12/1960 | Carper | 83/395 X |
| 3,682,029 | 8/1972 | Haas et al. | 83/881 X |

FOREIGN PATENT DOCUMENTS

| | | | |
|---|---|---|---|
| 167659 | 2/1951 | Austria | 83/467 A |
| Ad.1075 | of 1872 | United Kingdom | 83/467 A |

*Primary Examiner*—James M. Meister

*Attorney, Agent, or Firm*—Sughrue, Mion, Zinn, Macpeak & Seas

[57] ABSTRACT

Apparatus for cutting printing plates, comprises a cutting press with relatively movable platens one of which carries a form cutting tool for severing or partially severing from a processed sheet of flexible material a central image-bearing portion for use as a printing plate. Retractable registration and holding means engage registration targets on said sheet so as to locate the sheet in registry with the form cutting tool and to hold the sheet in position at least until it is held by the pressure of the cutting tool thereon.

7 Claims, 4 Drawing Figures

APPARATUS FOR CUTTING PRINTING PLATES

FIELD OF THE INVENTION

The present invention relates to apparatus for cutting printing plates made of thin flexible sheet material, e.g. paper or plastics material.

BACKGROUND OF THE INVENTION

In relief plate or letterpress printing a printing plate is produced by a photographic process. A backing sheet of flexible material of substantially larger area than the image to be reproduced thereon is given a sensitised coating which is then exposed to the image. The exposed sheet undergoes various treatment stages, e.g. developing, washing, etching. A central area of the sheet is now occupied by the image which is comprised of the residual coating and thus stands proud of the backing sheet as do registration targets formed by the photographic process alongside and in predetermined relation to the image.

The finished sheet has to be trimmed to form the printing plate. Normally this is accomplished by positioning the sheet accurately on a suction plate using registration fingers locating in the registration targets. Suction is then applied through the suction plate to hold the sheet in position. The registration fingers are then withdrawn and pairs of cutting blades are moved inwards over respective sides of the sheet to sever the central image area from the border inclusive of the registration targets. The border areas are discarded leaving the printing plate ready for the next operation in which holes are punched in the edges at opposite ends. Finally, these edges are turned over by a bending operation and the printing plate is now ready for attachment to a saddle of a press cylinder.

The equipment required for such a cutting operation is complicated and expensive. Not only are registration means required for accurately locating the sheet for cutting but the registration means then have to be withdrawn prior to the cutting operation so as to avoid interference with the incoming cutter blades. Even if this were not the case, the registration means would not serve to hold the sheet firmly during the cutting operation. The cutting blades have a shearing action which would tend to pull the sheet away from any such retaining means. Accordingly, it is necessary to anchor the sheet by suction during the cutting operation. Furthermore, the cutting and bending operations have to be carried out sequentially.

In our copending U.S. applications Ser. Nos. 341,725 and 341,726 both filed Jan. 22, 1982, by Kevin G. Davies and John R. Marsh, and both entitled "A Mechanism for Securing a Printing Plate to a Printing Cylinder" we describe printing plate securement techniques not requiring punching of holes in the edges of the printing plates. However, even with such improvement the prior art methods for producing the printing plate are complicated and expensive in terms of capital equipment and running costs.

It is an object of the present invention to obviate or mitigate the aforesaid disadvantage by the provision of simple and effective apparatus for cutting printing plates.

SUMMARY OF THE INVENTION

According to the present invention there is provided apparatus for cutting printing plates, comprising a cutting press with relatively movable platens one of which carries a form cutting tool for severing or partially severing from a processed sheet of flexible material a central image-bearing portion for use as a printing plate, and retractable registration and holding means for engaging registration targets on said sheet so as to locate the sheet in registry with the form cutting tool and to hold the sheet in position at least until it is held by the pressure of the cutting tool thereon.

The present invention will now be described by way of example with reference to the accompanying drawings.

DESCRIPTION OF THE PREFERRED EMBODIMENT

Figure 1:
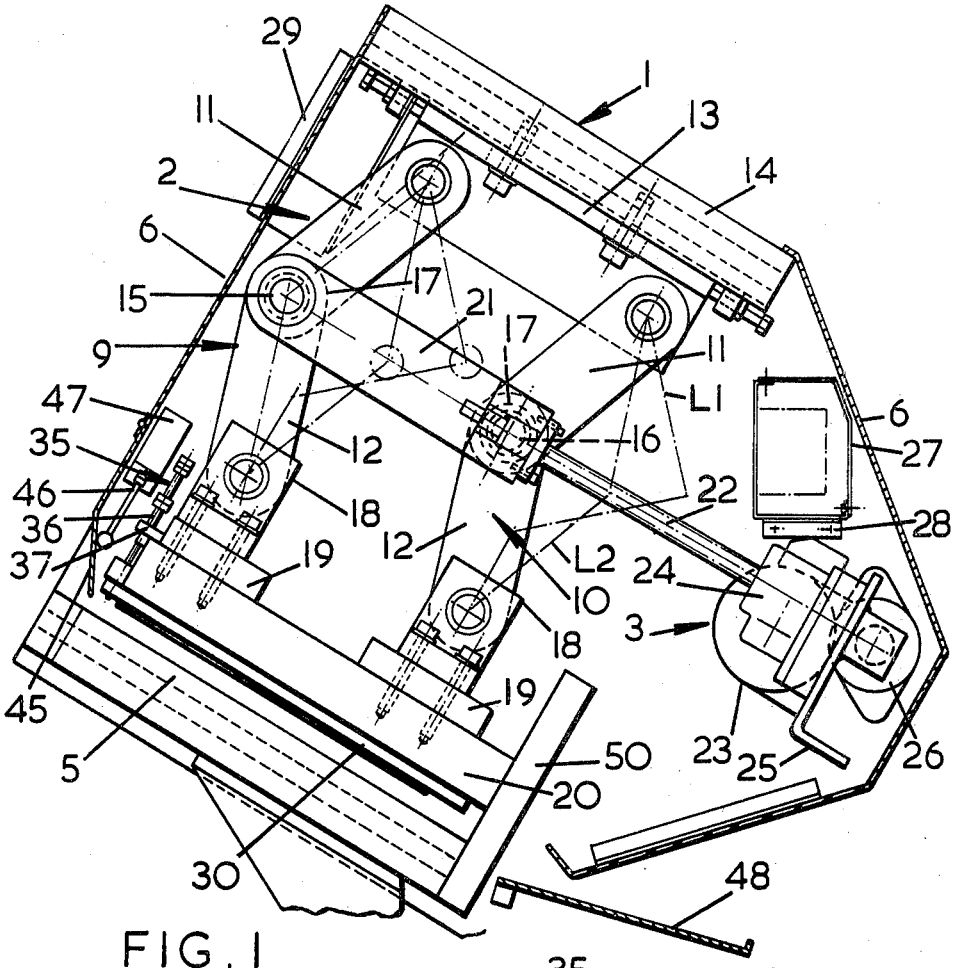
FIG. 1 is a side elevation of a cutting press according to the present invention shown with part of the casing of the press omitted.
Figure 2:
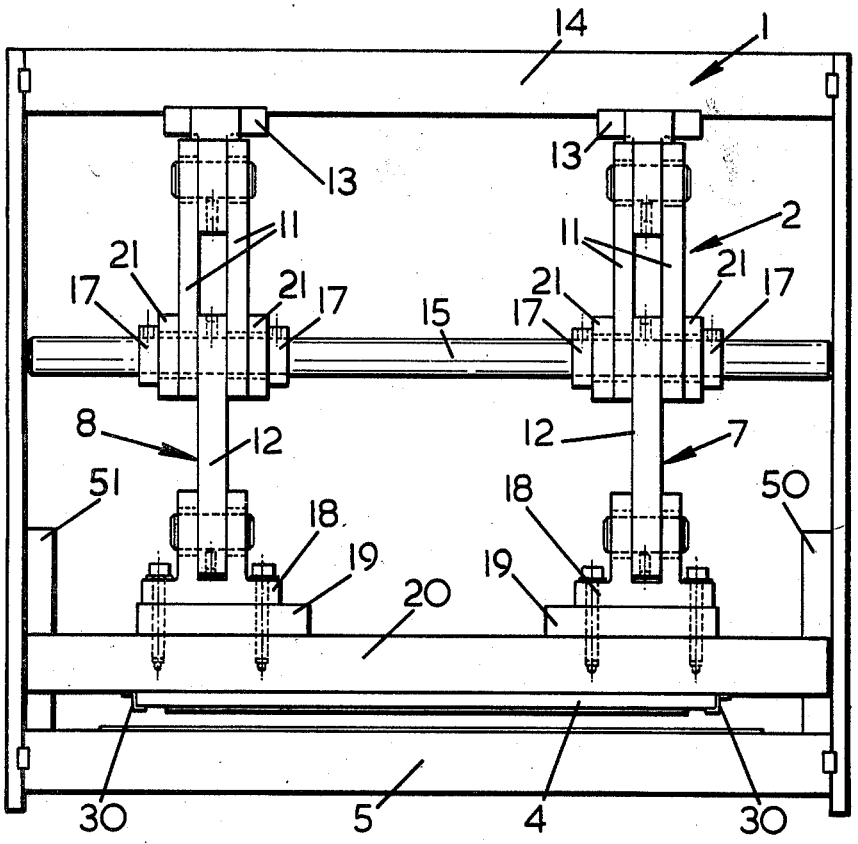
FIG. 2 is a front elevation of the press shown in FIG. 1 with some elements omitted for clarity.

The cutting press shown in FIGS. 1 and 2 comprises a substantially rectangular frame 1 to which is attached a toggle arrangement 2 movable by a screw jack mechanism 3 which is also attached to the frame 1. The toggle arrangement 2 has connected thereto a form cutter 4 which is thereby reciprocable towards and away from a base plate 5 of the frame 1 to cut, for example, a printing plate located between the cutter 4 and the plate 5. For safety reasons, the open areas of the frame 1 are covered by cladding 6 so that the press is enclosed.

The toggle arrangement 2 comprises two interconnected pairs 7, 8 of parallel front and back toggle mechanisms 9 and 10 respectively, which pairs 7, 8 are themselves parallel. Each mechanism 9, 10 comprises a first upper pair of parallel links 11 and a lower link 12. The upper links 11 of the mechanisms 9, 10 of each pair 7, 8 are pivotally and adjustably mounted at their upper ends via a single pivot block 13 to an upper plate 14 of the frame 1 and at their lower ends to pivot pins 15, 16 respectively for each mechanism 9, 10. Collars 17 retain the links 11 in position on the pins 15 and 16. The lower link 12 of each mechanism 9, 10 is pivoted at its upper end to the respective pin 15, 16 locating between the upper links 11, and at its lower end via a pivot block 18 and a packing piece 19 to a lower moving plate 20 which rests against back-plates 50 and 51 fixed to respective sides of the frame and to the base plate 5. The front and back mechanisms 9 and 10 of each pair 7, 8 are interconnected by a pair of links 21, which links 21 are attached between the pivot pins 15 and 16 and each link 21 locates between one of the collars 17 and an upper link 11. Likewise, the pairs 7, 8 of mechanisms 9 and 10 are interconnected by the pivot pins 15 and 16, the front pivot pin 15 interconnecting the front mechanism 9 of each pair 7, 8 and the back pivot pin 16 interconnecting the back mechanisms 10 of each pair 7, 8.

The screw jack mechanism 3 comprises a rotary screw 22 which is driven by a motor 23 attached to a bracket 25 at the rear of the press. The screw 22 passes at one end through a screw threaded bore in the centre of the back pivot pin 16 and is attached at its other end to a drive control mechanism 24 operated by the motor 23. The control mechanism 24 is attached to the bracket 25 and thereby to a bearing 26, which is mounted on side plates forming the cladding, so that the mechanism 24 and the screw 22 can oscillate as the toggle arrangement 2 is operated to remain in alignment therewith. The motor 23 itself is controlled via circuitry which is contained within a control box 27 mounted on a bracket 28 attached to the cladding and which is responsive to the main controls for the press located in a box 29 mounted on the front of the press (FIG. 1).

It can be seen that the screw jack mechanism 3 acts on the toggle arrangement 2 such that rotation of the screw 22 in the appropriate direction moves the pivot pin 16 and thereby the pin 15 via the links 21 towards or away from the front of the press so that the separate toggle mechanisms 9 and 10 pass through an over-centre position and force the moving plate 20 downwards towards the base plate 5 to perform a cutting operation. Each time the toggle mechanisms 9 and 10 pass through their over-centre position a separate cutting operation can be accomplished. The moving plate 20 slides up and down the back-plates 50 and 51 as the toggle mechanism is operated by the screw jack mechanism 3.

As shown in FIG. 1, the frame 1 is inclined to the horizontal so that the press is sloped downwardly at approximately 30° from front to back. Hence the upper plate 14, the moving plate 20 and the base plate 5 incline downwards away from an operator of the press located adjacent the front face thereof. This inclination of the plates 5, 14 and 20 has several advantages over conventional presses where equivalent plates are horizontal but one important advantage is that the moving plate 20 does not have to be guided (save by the back-plates 50 and 51) to ensure it remains in-line with the base plate 5.

Figure 3:
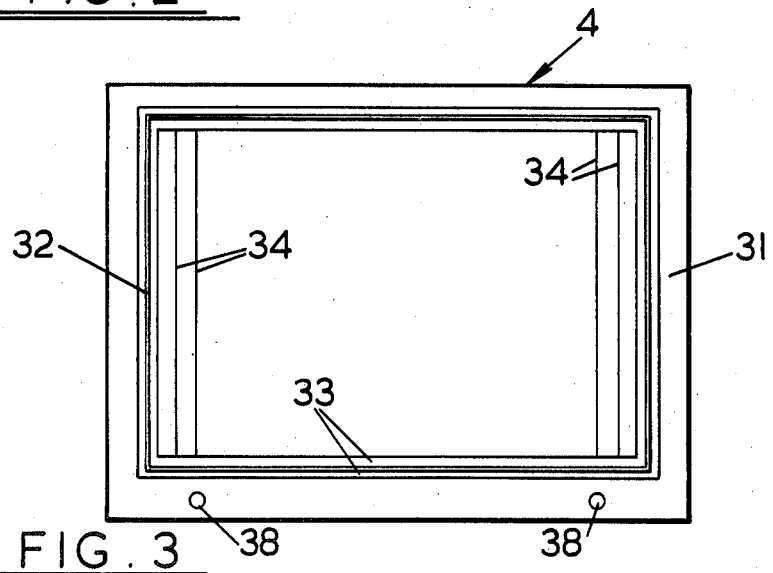
FIG. 3 is a view, from below, of a rule form cutter for use in the press shown in FIGS. 1 and 2.

The form cutter 4 is detachably connected to the underside of the moving plate 20 by slides 30 and on passage of the toggle mechanisms 9 and 10 through their over-centre position the cutter 4 is pressed against the base plate 5 to perform one cutting operation. A typical cutter 4 for use in the cutting and creasing of paper or plastics printing plates is shown in FIG. 3. The cutter 4 comprises a plate 31 in which have been accurately cut discontinuous slots to accommodate a metal strip blade 32 in the shape which it is desired to cut. The discontinuities in the slots locate in notches (not shown) in the blade 32 which is a tight friction fit in the slots. The blade 32 projects from the surface of the plate 31 and is covered on both sides thereof by resilient strips 33 made, for example, of rubber. These strips 33 are resiliently squashed during a cutting operation between the plate 31 and the base plate 5 so that the blade 32 can penetrate and thereby cut a printing plate located on top of the base plate 5. The function of the strips 33 is to protect the cutting edge of the blade 32 and to spring the cut pieces of the printing plate off the blade 32 once the cutting operation has taken place.

In addition to the cutting plate 31, creasing rules 34 may also be provided which comprise blunt blades and are attached to the plate 31 in the same way as the blade 32. During a cutting operation, the rules 34 do not penetrate the printing plate being cut but indent same to form a crease line. To ensure lack of penetration of the rules 34 into the printing plate, the base plate 5 is provided with grooves (not shown) which are located directly opposite the rules 34 on the cutter 4. On movement of the cutter 4 towards the base plate 5 the rules 34 push the portions of the printing plate adjacent the grooves therein so that the plate is indented and thereby creased but not cut.

As mentioned above, when cutting and creasing printing plates accuracy is essential and it is important that the cutter 4 is located on the moving plate 20 so that the cutter 4 is aligned correctly with regard to the grooves on the base plate 5. It is also necessary to provide a mechanism so that an operator can correctly position a printing plate to be cut on the base plate 5 in relation to the position of the cutter 4. These functions are fulfilled by two identical alignment mechanisms 35 which are located at the front of the press adjacent the two front pivot blocks 18.

Figure 4:
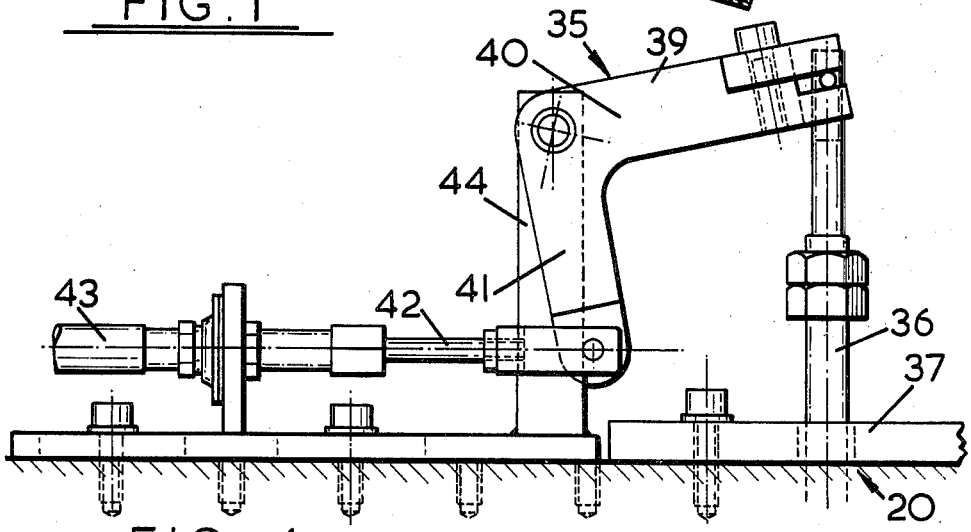
FIG. 4 is a detailed view, to an enlarged scale, of an alignment mechanism for use in the press shown in FIGS. 1 and 2.

As shown in FIG. 4, each alignment mechanism 35 comprises an alignment plunger 36 which is adapted to pass through an aperture located in a support 37 attached to the front of the moving plate 20 and through an accurately located hole 38 (FIG. 3) formed for this purpose in the form cutter 4. The plunger 36 is reciprocable so that it can be used to align a printing plate on the base plate 5 and by engagement with the registration targets thereon lightly hold the plate in position on the plate 5 during cutting. To this end, the plunger is attached at its upper end to one arm 39 of a bell-crank lever 40, the other arm 41 of which is connected via a rod 42 to a Bowden cable 43. The lever 40 is pivoted at its elbow joint to a post 44 attached to one of the front packing pieces 19 so that by pulling on the Bowden cable 43 the lever 40 pivots to thrust the plunger 36 downwardly towards the base plate 5. Relaxation of the cable 43 enables the lever 40 to pivot to draw the plunger 36 upwardly. To facilitate use of the mechanism 35 by an operator wishing to align a printing plate in position, the Bowden cables 43 of both mechanisms 35 are attached to a kick-bar (not shown) located at the base of the press on the support on which the frame 1 is mounted. In this way, an operator can use both hands to locate the printing plate to be cut on the base plate in the correct position relative to the plungers 36 and use one foot to operate the bar to cause the plungers 36 to project to clamp the printing plate against the base plate 5.

As a safety measure, a door 45 is attached to the cladding at the front of the press. There is a gap beneath the door 45 to enable a printing plate to be located between the cutter 4 and the base plate 5 but which gap is insufficient to permit tampering with the cutter 4 or the toggle arrangement 2. The door 45 is opened and closed by hand and a limit switch 46 provides part of an interlock circuit located in a box 47. This circuitry prevents the toggle arrangement 2 from being operated whilst the door 45 is open.

Since in most operations involving the cutting and creasing of printing plates it is desired to trim the edge from the plate, the press can be provided with a tray 48 at the rear to catch the trimmed plates. It will be appreciated that after the edge has been cut from a plate, the plate itself will slide down the base plate 5 on retraction of the cutter 4 from the base plate 5 and can be caught in the tray 48. The surround, which has been cut from the printing plate and which is held by the plungers 35 can then be removed via the door 45. Alternatively, the tray 48 can be omitted and the cutter 4 arranged not to sever the printing plate from the surround but to leave it attached thereto at two points so that the printing plate and surround can both be removed via the gap under the door 45 and the printing plate then simply detached from the surround manually.

In use, in order to cut and crease a printing plate, the plate to be cut is located, beneath the door 45, between the base plate 5 and the forme cutter 4 mounted on the moving plate 20. The printing plate is then aligned by using the mechanism 35 via the kick-bar. This is accomplished by lining up the plungers 36 with the registration targets on the printing plate.

It will be appreciated that in this regard the tilt of the press facilitates the location by the operator of the printing plate in position and gives a clearer view of the plate's position in relation to the plungers 36.

Once the printing plate has been aligned, it is held in position by the plungers 36 and the press is then activated to perform a cutting operation. The screw jack mechanism 3 is used to move the toggle arrangement 2 so that the separate toggle mechanisms 9 and 10 are moved by the screw 22 through their over-centre position. As this happens, the plate 20 together with the form cutter 4 is lowered towards the base plate 5 and as it moves into the dead-centre position of the toggle mechanisms 9 and 10, the printing plate is actually cut and creased. As the toggle mechanisms 9 and 10 continue in their movement through the dead-centre position, the moving plate 20 begins to move upwardly away from the base plate 5. The cut and creased printing plate is then gripped by hand at its front edge, the kick-bar is released to withdraw the plungers 36 of the mechanism 35 and the plate is withdrawn from the press. Alternatively, the tilt of the press enables the cut plate to slide out of the press into the tray 48 when the mechanism 35 is released.

In order to enable the rule form cutter 4 to be replaced, the screw jack mechanism 3 can retract the moving plate 20 a substantial distance above the base plate 5 by running the screw 22 in a lifting direction for a longer period than usual. FIG. 1 shows this raised position in chain-dot line L1, the normal raised positions for operation being shown in full line and in chain-dot line L2. A solenoid-releasable latch arrangement (not shown) is provided for mechanically holding the toggle mechanism in the extreme raised position, as a safety precaution. The door 45 at the front of the press is then opened and the cutter 4 removed from the slides 30 and another put in its place.

The apparatus of the present invention has several advantages over the prior art. The combination of the toggle arrangement 2 with a rule form cutter 4 enables cutting to take place in a controlled accurate manner, which is necessary for printing plates and particularly appropriate for modern flexible printing plates e.g. of plastics or paper. In addition, the shape of the form cutters 4 can be easily and cheaply changed. The screw-jack mechanism 3 is of simple construction, inexpensive as compared to known hydraulic or pneumatic systems and unlike them is smooth running and silent. Finally, the tilt of rhe press provides several advantages are described above.

What is claimed is:

1. Apparatus for cutting printing plates, said apparatus comprising:

a cutting press having relatively movable platens, one of said platens carrying a form cutting tool for at least partially severing from a processed sheet of flexible material, a central image-bearing portion for use as a printing plate, and retractable registration and holding means for engaging registration targets on said sheet so as to locate the sheet in registry with the form cutting tool and to hold the sheet in position at least until it is held by the pressure of the cutting tool thereon, and wherein the registration means comprises reciprocal plungers mounted on said one platen so as to pass through respective holes in the cutting tool for engagement with the registration targets on the processed sheet when the press is open.

2. Apparatus as claimed in claim 1, wherein the cutting tool is detachably attached to the respective platen so as to be replaceable by another form cutting tool for cutting a printing plate of different size.

3. Apparatus as claimed in claim 1 or 2, wherein the cutting tool comprises an attachment plate mounting cutter blades with protruding cutting edges defining the profile of the printing plate to be cut out of the processed sheet.

4. Apparatus as claimed in claim 3, wherein the cutting edges are notched so that the cutting tool only partially severs the printing plate from its surround.

5. Apparatus as claimed in claim 1, wherein the press comprises a fixed lower platen affording a support surface for the processed sheet and the cutting tool is carried by the upper platen.

6. Apparatus as claimed in claim 1, wherein the press has drive means acting on the movable platen through a toggle mechanism, and wherein said toggle mechanism includes means whereby each over-centre movement of the toggle mechanism causes the cutting tool to perform a cutting operation, said drive means is a screw jack, and wherein the press platens are inclined to the horizontal so that the processed sheet is located in an inclined plane for the cutting operation.

7. Apparatus as claimed in claim 6, wherein the form cutting tool incorporates creasing blades for creasing the printing plate as it is being cut.

* * * * *